United States Patent [19]

Gehri

[11] 4,164,416

[45] Aug. 14, 1979

[54] METAL RECOVERY PROCESS

[75] Inventor: Dennis C. Gehri, Agoura, Calif.

[73] Assignee: Rockwell International Corporation, El Segundo, Calif.

[21] Appl. No.: 925,665

[22] Filed: Jul. 17, 1978

Related U.S. Application Data

[63] Continuation-in-part of Ser. No. 752,218, Dec. 20, 1976, abandoned.

[51] Int. Cl.[2] ..... C22B 13/00; C22B 15/00

[52] U.S. Cl. ..... 75/72; 75/77; 423/DIG. 12

[58] Field of Search ..... 75/1, 21, 23, 26, 72, 75/73, 74, 75, 76, 77, 78, 79, 92; 423/DIG. 12

[56] References Cited

U.S. PATENT DOCUMENTS

| | | | |
|---|---|---|---|
| 821,330 | 5/1906 | Betts | 75/77 |
| 1,740,752 | 12/1929 | Thompson | 75/78 |
| 1,881,164 | 11/1932 | Freeman | 75/78 |
| 2,381,970 | 8/1945 | Collins | 75/77 |
| 2,834,669 | 5/1958 | Pendor | 75/21 |
| 3,291,597 | 12/1966 | Mellgren et al. | 75/79 |
| 3,647,358 | 3/1972 | Greenberg | 423/DIG. 12 |
| 3,663,207 | 5/1972 | Themelis et al. | 75/77 |
| 3,718,733 | 2/1973 | Gelvi | 423/210.5 |
| 3,754,074 | 8/1973 | Grantham | 423/210.5 |
| 3,867,514 | 4/1975 | Moore | 423/DIG. 12 |

FOREIGN PATENT DOCUMENTS

| | | | |
|---|---|---|---|
| 730985 | 6/1955 | United Kingdom | 75/77 |

OTHER PUBLICATIONS

APC, SN 292,742, Beck, et al., 07/13/1943.

*Primary Examiner*—L. Dewayne Rutledge
*Assistant Examiner*—Michael L. Lewis
*Attorney, Agent, or Firm*—L. Lee Humphries; Henry Kolin; Clark E. DeLarvin

[57] ABSTRACT

A process for the recovery of copper or lead from a sulfide ore concentrate containing the same. The ore concentrate, a carbonaceous material, an alkali metal carbonate and gaseous oxygen are introduced into a reaction zone to form a reaction mixture. The amount of carbonaceous material introduced is sufficient to reduce all of the copper or lead constituent of the sulfide ore to its elemental state in a single stage. A sufficient excess of carbonaceous material is provided to react with the oxygen and generate heat in situ to maintain the reaction zone at a temperature of from about 600° to 1350° C. thereby causing reduction of the metal sulfide to substantially pure copper or lead for recovery. The sulfur constituents of the ore react with the alkali metal carbonate to form sulfides. The other metal constituents of the ore are retained in the molten reaction mixture.

In accordance with a preferred embodiment of the invention involving regeneration of the molten reaction mixture, at least a portion of the sulfide-containing molten reaction mixture is removed, quenched in an aqueous solution, and filtered to remove any insoluble reaction products. The aqueous filtrate is contacted with a $CO_2$-containing gas, preferably obtained from the reaction zone, to liberate the sulfur for recovery and reform carbonate for recycle to the reaction zone.

11 Claims, 2 Drawing Figures

METAL RECOVERY PROCESS

CROSS REFERENCE TO RELATED APPLICATION

This application is a continuation-in-part of application Ser. No. 752,218 filed Dec. 20, 1976, now abandoned.

BACKGROUND OF THE INVENTION

1. Field of the Invention

The present invention relates to a process for the recovery of metal from ores which include substantial amounts of metal sulfides. More particularly, the present invention relates to the treatment of copper or lead sulfide ores for the recovery of the copper or lead as a substantially pure elemental metal in a single stage.

2. Prior Art

In the recovery of certain metals such as copper and lead from their respective sulfide ores, the metal frequently is found in the form of a sulfide. In addition to the specific metal of interest, such ores generally contain varying amounts of other metal sulfides. The generally available ores in the United States contain relatively low concentrations of such metals as copper and lead. Therefore, in the processing of such ores, it is the usual practice to form a concentrate or matte enriched in the metal of interest. Such concentrates may be formed by beneficiation or leaching of the ore to produce a concentrate richer in the desired metal constituents. In addition, or as an alternative thereto, the ore may be roasted or sintered to further concentrate the desired metal constituent.

The recovery of metals such as copper and lead from their naturally occurring sulfide ores is a complex process involving numerous process steps or stages. Sulfide ores are by far the most important ores of copper. They are usually complex mixtures of copper and iron sulfides associated with compounds of iron, zinc, arsenic, antimony, bismuth, selenium, tellurium, silver, gold and platinum. The principal copper sulfide or minerals are boronite, chalcopyrite, enargite, covellite and chalcocite. In the recovery of copper, the copper sulfide ore typically containing from about 1 to 5 wt % copper is first subjected to a concentrating step by either leaching the ore, using mechanical separation or employing flotation techniques to provide a copper concentrate containing typically from 15 to 40 wt % copper. The copper concentrate then is introduced into a roasting furnace to drive off the volatiles such as moisture and uncombined sulfur. The ore from the roaster now comprising about 25 to 45 wt % copper is introduced into a reverberatory furnace, wherein it is further treated to provide what is known in the trade as a copper matte, and which contains from about 40 to 45 wt % copper. The copper matte is introduced into a converter and reacted at elevated temperatures with air, wherein a part of the copper sulfide forms copper oxide which reacts with some of the remaining copper sulfide to yield elemental copper and a sulfur dioxide off-gas. The product from the converter generally is referred to as blister copper and contains from 98 to 99 wt % copper. The blister copper then is subjected to fire refining in the presence of a reducing agent to produce a product copper having a purity greater than 99%.

The processing of lead sulfide ores also involves a plurality of steps or stages. Galena (PbS) constitutes the most common and important of all the lead minerals.

Where required, the lead sulfide ore is first subjected to concentrating techniques to provide an ore concentrate which typically will contain from 45 to 80 wt % lead. The lead concentrate then is subjected to a sintering operation to evolve some sulfur and other volatiles such as water. The product from the sintering operation is introduced into a blast furnace where it is reacted with coke to reduce the lead and produce an off-gas containing $SO_2$. The lead product from the blast furnace, referred to as bullion, will contain from about 94 to 98 wt % lead. The bullion is introduced into a drossing furnace, where it is fluxed with an alkali metal salt such as sodium carbonate to remove residual impurities. The product from the drossing furnace, usually referred to as a dross, comprises 99 wt % lead. The dross usually is subjected to a softening operation wherein other constituents of the ore, such as tin, antimony, and arsenic, are volatilized and driven off and a final lead product having a purity of about 99.9% is obtained.

Numerous descriptions of the various steps of metal-refining processes are found in standard references as well as in the patent literature.

An example of lead-smelting process is found in U.S. Pat. No. 821,330. The patent discloses a process for reducing the lead sulfide ore which comprises smelting it, preferably in a reverberatory furnace, with carbon, iron oxide, and sodium carbonate to produce metallic lead and a fusible iron-sodium matte.

In U.S. Pat. No. 862,378 there is disclosed a method of smelting and refining copper ores. The copper ore, containing combustible impurities in an amount sufficient to generate the required heat necessary in the smelting operation without the addition of carbonaceous fuel, is first subjected to a combined smelting and converting operation. A copper matte is produced which is then transferred in molten form to a converter vessel where it is subjected to an air blast in the presence of siliceous ores to eliminate the iron contained in the matte. In the converter a slag containing various impurities is formed and removed, leaving a blister copper which is then transferred in molten form into a preheated refining furnace for elimination of any residual oxides and production of essentially pure copper.

U.S. Pat. No. 2,823,990 relates to a process for the treatment of lead ores. An ore concentrate, containing more than 40 wt % lead in the form of lead sulfide, in admixture with soda and carbon, is wetted with water and smelted in a flame-fired rotary furnace at a temperature between 700° and 1000° C. to recover a high purity lead.

U.S. Pat. No. 919,130 discloses a process for extracting copper from its ores. The process comprises mixing a copper ore with a carbonaceous material and carbonates of the alkali and alkaline earths and subjecting the mixture to heat in a closed retort to produce metallic copper.

More recently in U.S. Pat. No. 2,834,669, there is disclosed another process for the extraction of a metal such as lead from its sulfide. The process comprises melting lead sulfide in the presence of sodium carbonate, an oxide selected from the group consisting of zinc oxide, iron oxide, silica and lime, sodium chloride and carbon, thereby causing reduction of lead sulfide to lead.

U.S. Pat. No. 3,899,322 relates to a molten salt process for the recovery of certain noble-type metals (such as copper or silver) from scrap containing the same. The process comprises feeding the noble-type metal value-containing scrap and a source of uncombined gaseous oxygen into a pool of molten salt consisting essentially of sodium carbonate and containing about 1 to 25 wt % sodium sulfate. The temperature of the molten salt is maintained between 800° and 1800° C. and above the melting point of the noble-type metal to thermally decompose the scrap to form separable scrap decomposition products and said metal. This patent however does not describe the treatment of sulfide ores or mattes derived therefrom.

Other patents which relate to the combustion of carbonaceous fuels and carbon-containing waste in a molten alkali metal salt for various purposes are known. U.S. Pat. No. 3,710,737 shows the generation of heat for external use employing a variety of carbonaceous materials. U.S. Pat. Nos. 3,567,412; 3,708,270; and 3,916,617 show the use of such techniques for the production of pyrolysis gases. In U.S. Pat. Nos. 3,778,320 and 3,845,190 such techniques are involved, respectively, in the nonpolluting disposal of explosives and of organic pesticides. None of these patents are concerned with the recovery of metals from their sulfide ores.

In many of the prior art processes wherein sulfide ores are roasted or sintered, a significant amount of gaseous sulfur dioxide is produced and constitutes a potential pollutant. Further, in subsequent refining of the ore concentrates or mattes, many typical processes evolve additional sulfur dioxide. Public concern regarding the quality of the environment has resulted in legislation regulating the amount of pollutants, such as sulfur dioxide, which may be discharged into the atmosphere.

Clearly, there exists a need for an economical, nonpolluting, single stage process for the recovery of metals from their sulfide ores in a substantially pure elemental form.

SUMMARY OF THE INVENTION

In accordance with the present invention, there is provided a nonpolluting process for the recovery of copper or lead from its respective sulfide ore. The present process is applicable to the recovery of copper and lead from their naturally occurring ores, minerals, concentrates, or mattes containing the copper or lead as a sulfide compound and which also may contain substantial amounts of iron sulfide and other impurities. The present process is applicable to ores or concentrates containing the copper or lead as a sulfide, wherein the copper or lead comprises from 20 to 85 wt % of the ore or concentrate.

It is a particular advantage of the present invention that it is possible to treat such an ore of its concentrate in an environmentally acceptable, single stage and to obtain a product metal having a purity equal to or greater than that obtained after using the several, more complex treatment stages involved in the prior art processes. The simplified metal recovery process provided by the present invention is particularly suitable for the recovery of high purity copper and lead from their sulfide ores, since these two metals provide an overall balance of the following desirable features: the melting point of both the metal sulfide and of the recovered metal is below a convenient operating temperature of the molten reaction mixture for the recovery process; both metals are relatively inert or nonreactive with the alkali metal carbonate employed and do not form an oxide with the constituents of the molten reaction mixture; and both metals have a relatively low volatility in relation to the operating temperature employed in the recovery process.

In accordance with the present process, a sulfide ore containing copper or lead, a carbonaceous reducing agent, an alkali metal carbonate and gaseous oxygen are introduced into a reaction zone to form a reaction mixture. The alkali metal carbonate and sulfide ore are introduced in an amount to provide a molar ratio of carbonate to metal sulfide of at least about 1.2:1. A particularly preferred molar ratio is in the range of from about 1.2:1 to 2:1.

It is a key feature of the present invention that the reaction mixture of an alkali-metal carbonate, carbonaceous reducing agent, and sulfide ore comprises a major amount of alkali-metal carbonate. Rather than using a minor amount of alkali-metal carbonate as a flux to cause other substances present in the ore to melt more readily by dissolving their oxides or suface impurities, in the present process the carbonate is a reactant which reacts with substantially all of the sulfur constituents of the ore to form alkali-metal sulfides. Thus, these potentially polluting sulfur constituents are retained in the reaction mixture. Still further, rather than using the alkali-metal carbonate as a flux layer, the alkali-metal carbonate forms a major part of the reaction mixture and the sulfide ore and carbonaceous material are introduced to form a substantially homogenous mixture. Oxygen also is introduced into the reaction mixture to react with the excess of carbonaceous reducing agent such that the heat required for the metal reduction reaction is generated in situ in the mixture. The alkali metal carbonate also acts as a heat sink to ensure that the temperature is substantially uniform throughout the reaction mixture. The oxygen preferably is introduced into a bottom portion of the reaction mixture to ensure uniform mixing and intimate contact between the reactants. Thus, the present invention provides a process wherein it is possible to obtain in a single operation a substantially pure metal. The exact degree of purity will, of course, depend to some extent on the quantity and types of impurities present in the ore. Generally, however, with the ores described herein and a reaction mixture comprising a major amount of alkali-metal carbonate, it is possible to obtain a product metal having a purity of at lest 98% and generally in excess of about 99% in a single operation. The carbonaceous reducing agent is introduced in an amount sufficient to reduce all of the metal sulfide to its elemental form, and there also is provided a sufficient excess to react with the oxygen and generate in situ substantially all of the heat required to maintain the reaction zone at a temperature within a range of from about 600° to 1350° C. for a time sufficient to reduce a desired amount of the metal sulfide to its elemental form. The formed molten metal reaction product settles to the bottom of the reaction zone where it is readily recoverable as a flowable liquid. Substantially all of the other constituents of the ore such as other metal sulfides and oxides are retained in the molten reaction mixture. The temperature in the reaction zone preferably is maintained above the melting point of the copper or lead metal such that it is readily recoverable as a flowable liquid substantially free of impurities. Further, since the sulfur constituents are retained in the molten salt, the off-gas from the reaction zone is nonpolluting, i.e., essentially free of sulfur.

In accordance with the present process the sulfide ore reacts with the carbonaceous material and the molten alkali metal carbonate. The basic overall chemical reactions involved in the process (where M stands for copper or lead) are:

$$MS + Na_2CO_3 + C \rightarrow M + Na_2S + CO + CO_2 \quad (1)$$

$$Na_2S + 2O_2(g) \rightarrow Na_2SO_4 \quad (2)$$

$$Na_2SO_4 + 2C(s) \rightarrow Na_2S + 2CO_2 \quad (3)$$

It will be appreciated that the foregoing formulas only exemplify the overall reactions taking place in the reaction zone. Obviously, the exact mechanism by which the copper or lead is reduced is substantially more complex and probably involves several intermediate reactions.

In accordance with the present process, the molten reaction mixture may comprise a single alkali metal carbonate or a mixture of alkali metal carbonates. The molten reaction mixture also will contain alkali metal sulfide, the alkali metal sulfide being formed in situ by the reaction of the sulfide feed materials with the alkali metal carbonate.

A low melting binary or ternary mixture of alkali metal carbonates may be utilized; for example, a ternary alkali metal carbonate mixture containing the carbonates of lithium, sodium, and potassium. An exemplary binary mixture is a sodium carbonate-potassium carbonate eutectic which melts at 710° C. Preferably, the alkali metal carbonate is sodium carbonate. An advantage of using sodium carbonate is that it is lower in cost and, further, when substantial portions of carbonate are reacted with other constituents of the ore, such as sulfur, to form alkali metal sulfide, the sodium form is more readily amenable to processing to recover the sulfur and reform the carbonate for recycle to the reaction zone to treat additional ore.

Essentially, any carbonaceous material providing a source of active carbon may be utilized in the present process as a solid carbonaceous reducing agent. Preferably, the carbonaceous reducing agent will be low in ash content (less than 10 wt % ash) and one which is relatively inexpensive. Such materials include some coals, coke, asphalt, tars, pitches, petroleum residues, and the like. The use of petroleum coke is preferable. Many of these substances ordinarily are heavily contaminated with sulfur-containing materials and are of little or no economic utility. In the present process, however, such materials may be utilized, since any sulfur contaminants present will be retained in the molten reaction mixture. Further, the sulfur is subsequently recoverable as a salable by-product, as will be discussed later.

The carbonaceous reducing agent is introduced into the reaction zone in an amount sufficient to reduce all of the selected metal sulfide to its elemental form. In addition, there also is provided a sufficient excess of the carbonaceous reducing agent to maintain the temperature within the reaction zone within a desired range for a time sufficient to reduce the selected metal sulfide to its elemental form. The total amount of carbonaceous reducing agent will vary, of course, depending upon the heat loss from the reaction zone and the volume of molten reaction mixture contained therein, as well as the amount of ore being processed and the amount of reactive metal sulfides in the feed. Such amount is readily determinable through routine experimentation.

The amount of oxygen-containing gas utilized is regulated to oxidize substantially all the excess carbonaceous reducing agent under optimized conditions to maximize carbon dioxide formation, thus providing heat and a carbon dioxide-rich product gas, which product gas may be efficiently utilized in a manner to be discussed later. However, use of an undue excess of oxygen is to be avoided so as not to have unnecessary consumption of the carbonaceous material or possible oxidation of the recovered molten metal. The gaseous oxygen added to the process may be in any form which is reactive with the alkali metal sulfide to form a sulfate, which reaction is highly exothermic. In general, air is a preferred form of gaseous oxygen for economic reasons. However, pure oxygen or oxygen-enriched air also may be used. The sulfate subsequently reacts with the excess carbonaceous reducing agent to form $CO_2$ and reform the alkali metal sulfide. For a further discussion of this reaction sequence to generate heat, see U.S. Pat. No. 3,710,737, "Method for Producing Heat," by Birk, the disclosure of which is incorporated herein by reference.

The temperature to be maintained within the reaction zone will vary, depending upon the particular metal which is being processed. Thus, for copper a temperature within the range of from about 1100° to 1350° C., and for lead a temperature within the range of from about 850° to 1000° C., are preferred. Particularly good results are obtained at temperatures of about 1200° C. and 900° C. for copper and lead, respectively.

The pressure within the reaction zone is not critical, and substantially any pressure from ambient up to 10 atmospheres or higher may be used. Higher pressures permit the process to be conducted at higher temperatures without vaporization of the selected metal or the molten salt, and the higher temperatures, of course, reduce the amount of time required for reduction of substantially all of the copper or lead sulfide to form the metal. However, higher pressures substantially increase the cost of the apparatus. Therefore, it generally is preferred to operate at the hereinbefore stated temperatures and at a pressure of from about 1 to 5 atmospheres. At such pressure and temperature the reaction generally is substantially complete in from about 5 to 30 minutes.

In accordance with a preferred embodiment of the invention, the process is continuous and there is withdrawn from the reaction zone a bleed or side stream of the molten reaction mixture, which is processed to remove any suspended solids, such as ash constituents of the ore and unreacted carbonaceous reducing agent. The bleed stream subsequently is regenerated for recycle to the reaction zone.

The bleed stream comprises a mixture of unreacted sulfide ore, unreacted carbonaceous reducing agent, unreacted alkali metal carbonate and the corresponding alkali metal sulfide. The bleed stream is quenched in an aqueous solution in a dissolver tank and then filtered, centrifuged, or the like, to remove any suspended solids such as ash (which will comprise a mixture of sulfides and oxides of those metal constituents of the ore having a higher melting point than the selected metal) and unreacted carbonaceous reducing agent. The substantially solids-free aqueous solution is then transferred to a reformer unit, where it is contacted with a $CO_2$-containing gas. The $CO_2$-containing gas advantageously is obtained from that produced in the reaction zone. The overall reaction in the reformer unit is represented by the following exemplary equations:

$$Na_2S + 2H_2O + 2CO_2 \rightarrow 2NaHCO_3 + H_2S$$

$$Na_2S + H_2O + CO_2 \rightarrow Na_2CO_3 + H_2S.$$

The hydrogen sulfide gas formed is discharged from the system, and the sulfur values then are readily recoverable from the hydrogen sulfide as elemental sulfur in a conventional Claus plant. The bottoms from the reformer unit, consisting principally of a sodium carbonate-sodium bicarbonate slurry, are removed and filtered. The filter cake then is dried or calcined and is suitable for recycle to the reaction zone.

The present invention and its advantageous features will be more fully set forth with reference to the following description of the drawings and examples, which are set forth for the purpose of illustration, and should not be construed as limiting the scope of invention.

DETAILED DESCRIPTION OF THE DRAWINGS

Figure 1:
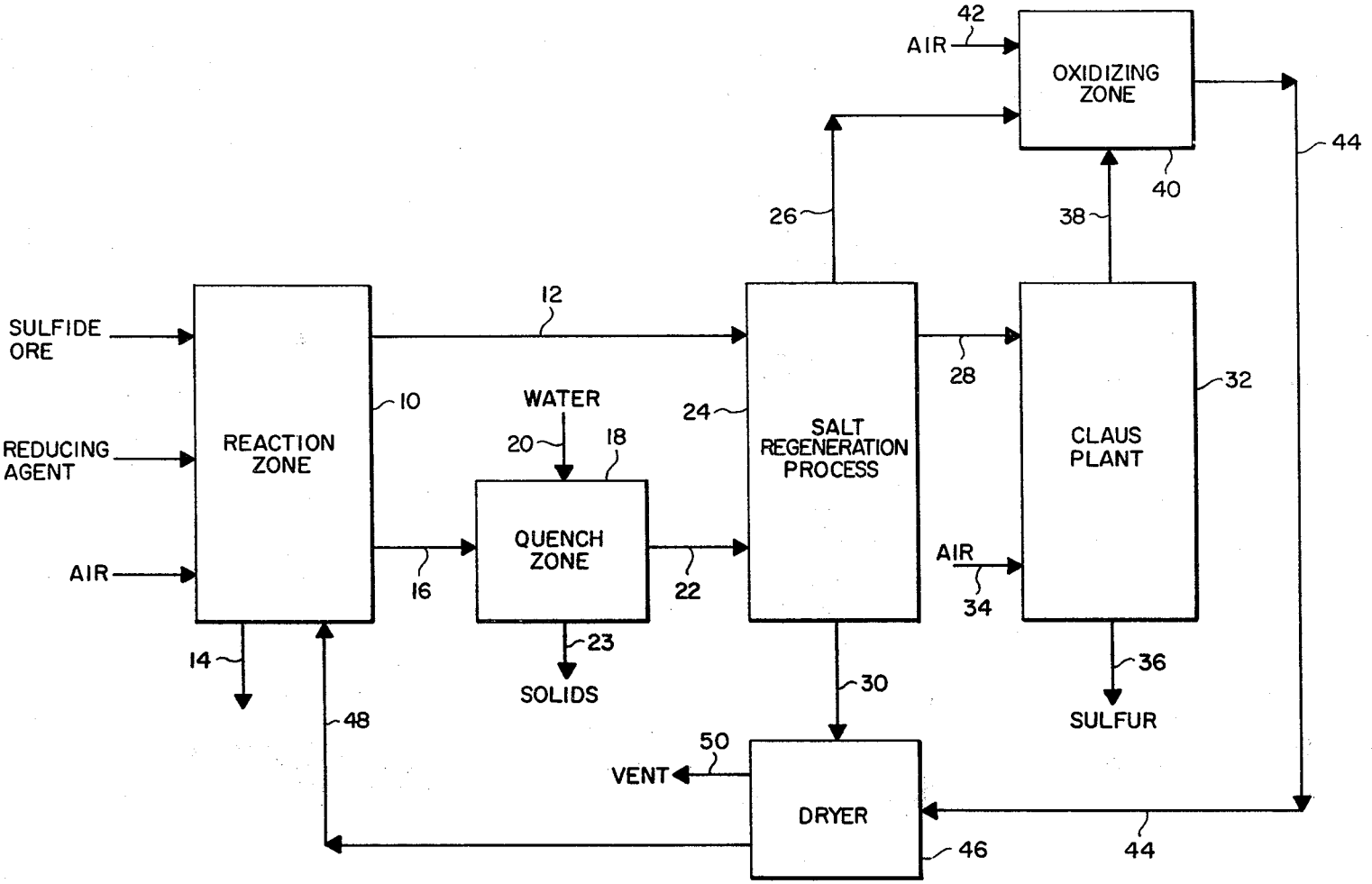
FIG. 1 is a schematic flow diagram of a preferred embodiment of the process of the present invention.

FIG. 1 is a schematic of a preferred embodiment of the metal recovery process of the present invention. A copper or lead sulfide ore or concentrate, a carbonaceous reducing agent, an alkali metal carbonate and gaseous oxygen such as air, are introduced into a reaction zone 10, to form a molten reaction mixture. The reaction zone preferably is maintained at a temperature above the melting point of the copper or lead. The pressure and temperature within the reaction zone are so selected as to be above the melting point of the alkali metal carbonate bath and below its boiling point. The ore and reducing agent react to reduce the metal sulfide and form copper or lead in its elemental form. An excess of carbonaceous reducing agent is provided which reacts with the oxygen to generate heat in situ. Portions of the air react with some of the more reactive other metal constituents of the ore such as iron, tin, and zinc to form metal oxides which are retained in the molten salt. In addition, the sulfur constituent of the ore reacts with the carbonate to form alkali metal sulfides, which also are retained in the molten mixture. Thus, there is produced in reaction zone 10 a substantially sulfur-free gaseous product which leaves via a conduit 12 and comprises carbon monoxide, carbon dioxide, unreacted oxygen, and the nitrogen component of the air introduced. There also is produced in the reaction zone, under the preferred conditions, a molten pool of the selected copper or lead metal in elemental form which is withdrawn via a conduit 14 as a flowable liquid substantially free of impurities. The molten copper or lead is readily cooled and conveniently recovered as an ingot of high purity.

In accordance with a particularly preferred mode of operation, a bleed stream of the molten mixture is withdrawn and treated to remove the insoluble ash constituents, such as other metal oxides, recover the sulfur values as a salable product, and reform the alkali metal carbonate for recycle to the reaction zone. A bleed stream of the molten reaction mixturee is withdrawn via a conduit 16 and introduced into a quench zone 18, where it is dissolved in water which is introduced via a conduit 10. The aqueous solution formed in zone 18 is subjected to any suitable solids-liquid separation technique to recover the insoluble metal oxides as ash for disposal via a conduit 23. A substantially solids-free solution from quench zone 18 is passed via a conduit 22 to a salt regeneration process 24. The solution therein is treated with a $CO_2$-containing gas obtained from reaction zone 10 via conduit 12. Preferably, the solution is treated in two stages. In the first stage, the solution is contacted with only so much of the $CO_2$-containing gas as to precarbonate it and provide an off-gas substantially free of any sulfur, which is removed via a conduit 26; and in the second stage it is contacted with a substantial quantity of the gas wherein there is produced an $H_2S$-rich gas stream, which is removed via a conduit 28 and introduced into a Claus plant 32 for recovery of the sulfur values therefrom. An aqueous slurry of carbonate and bicarbonate crystals is formed in salt regeneration process 24 and withdrawn via a conduit 30. Air for use in the Claus plant 32 is introduced via a conduit 34. Elemental sulfur is recovered from Claus plant 32 via a conduit 36 as a salable product.

Also produced in the Claus plant is a waste or tail gas containing minor amounts of unrecovered $H_2S$, which passes through a conduit 38 and into an oxidizing zone 40, where it is combined with the product gas from the precarbonation stage of the salt regeneration process 24. Air also is introduced into oxidizing zone 40 via a conduit 42. In oxidizing zone 40, the carbon monoxide constituents and $H_2S$ constitutents of the combined streams from conduits 26 and 38 are oxidized to produce a hot product gas which exits from oxidizing zone 40 via a conduit 44. The product gas in conduit 44 consists essentially of carbon dioxide, unreacted oxygen, the nitrogen consitutents of the air, and a monor amount of sulfur dioxide resulting from the oxidation of the $H_2S$.

In a dryer 46 the aqueous slurry of bicarbonate crystals, introduced via conduit 30, is brought into intimate contact with the hot gas stream introduced via conduit 44 to dry the crystals. Advantageously, dry 46 is a spray dryer to provide the desired intimate contact between the slurry and the hot gas. The gaseous product is withdrawn from dryer 46 via a conduit 50 and vented to the atmosphere.

The use of the Claus plant waste gas, bicarbonate slurry and dryer in the manner described provides two desirable results: (1) the bicarbonate slurry is dried to provide carbonate for return to the reaction zone, for example, via a conduit 48, and (2) the waste gas is scrubbed by the aqueous bicarbonate slurry to remove any residual sulfur content. Thus, the gases vented via conduit 50 are substantially free of any sulfur constituents and can be vented to the atmosphere without any subsequent treatment being necessary. Thus, it is seen that in this specific preferred embodiment there is provided a substantially, continuous, closed, cyclic process wherein only one gaseous vent stream is required, and that gaseous stream is free of pollutants. In addition, the thermal energy requirements are minimized by the use of the waste gas from the regeneration process to provide dry carbonate crystals for return to the reaction zone. Still further, the selected metal is recovered substantially free of impurities in a single stage from reaction zone 10, and has a purity comparable to that obtainable in the prior art processes only when employing a plurality of separate process stages. These and numerous other benefits of the present invention will be apparent to those versed in the art.

Figure 2:
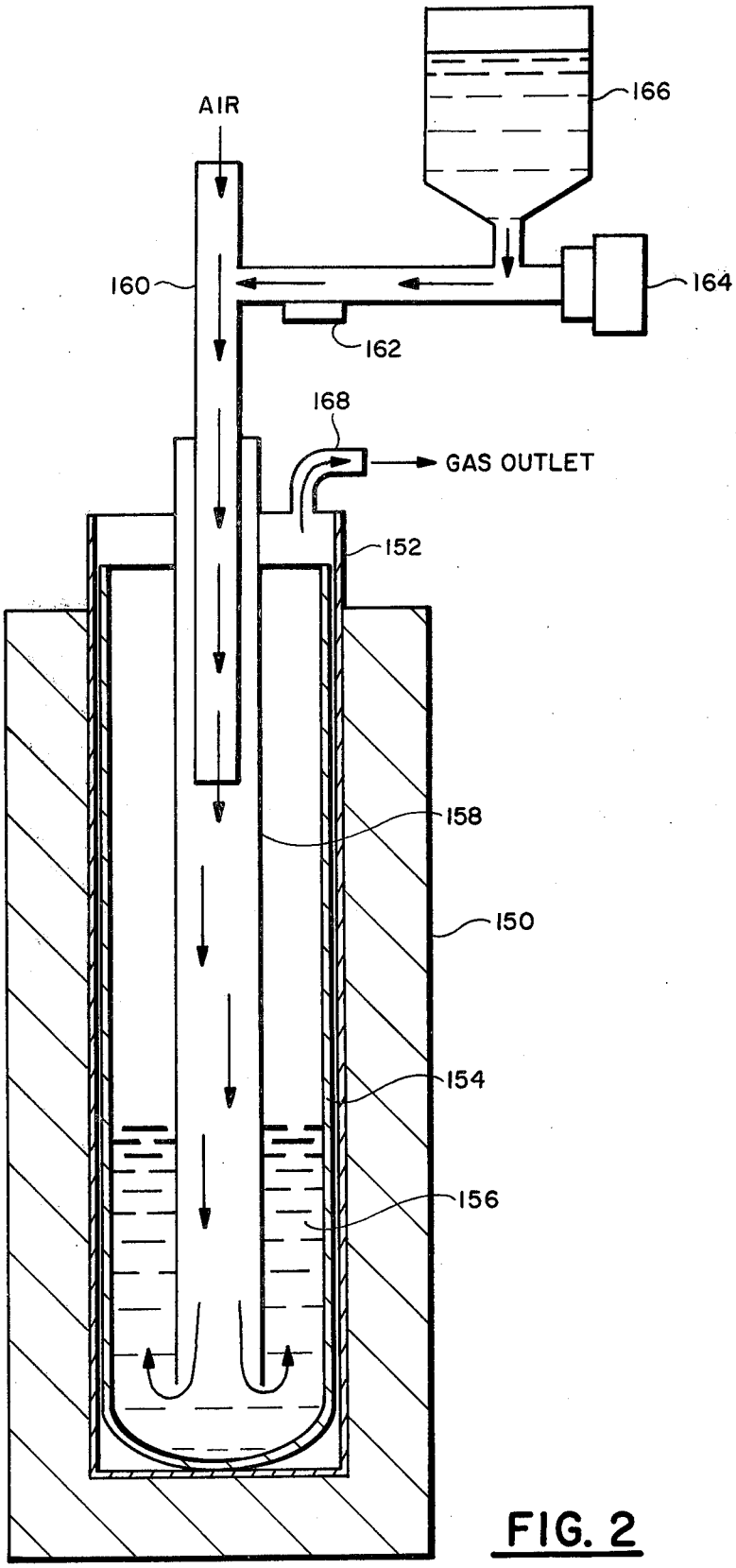
FIG. 2 is a schematic illustration of a laboratory apparatus for the recovery of copper or lead in accordance with the present invention.

Referring now to FIG. 2, therein is depicted a laboratory apparatus utilizable in accordance with the present process for recovering copper or lead from ores containing the same as sulfide compounds. The apparatus comprises a furnace 150 which includes a steel housing 152. Located within housing 152 is an alumina tube 154 which defines a reaction zone and contains a body of molten salt 156. Extending through the housing and into the alumina tube is a feed tube 158. Extending into and in coaxial alignment with feed tube 158 is an injector tube 160 for introducing an oxygen-containing gas and a mixture of an ore concentrate and carbonaceous reducing agent into the reaction zone. The apparatus further includes a vibrator 162, a screw feeder 164 and a hopper 166 which provides a means for regulating the rate at which the mixture of carbonaceous reducing agent and ore concentrate are introduced into the reaction zone. Steel housing 152 also is provided with a gas outlet port 168 for the removal of any gaseous reaction products. An apparatus substantially the same as that disclosed in FIG. 2 was utilized in the performance of the series of tests described in the following first five examples.

EXAMPLE 1

Six hundred grams of sodium carbonate and 350 grams of the copper matte (comprising 41 wt % cu, 30 wt % Fe, and 21 wt % S) obtained from a reverberatory furnace were introduced into the alumina tube 154 and heated to a temperature of about 871° C. About 30 grams of petroleum coke were then added. The temperature was increased to about 1132° C. and maintained substantially constant for about one-half hour. Thereafter, the temperature was reduced to ambient. A 65.6-gram ingot of solidified copper was recovered from the bottom of the alumina tube. Analysis of the ingot showed that it contained greater than 98 wt % copper substantially free of oxygen as oxides (less than 20 ppm $O_2$); 0.5% or less of nickel, lead, or zinc; 0.1% iron; and less than 0.2% of other metals, About 46 wt % of the total amount of copper contained in the feed was recovered. The low recovery was a result of having insufficient carbon present to reduce all of the copper to its elemental form for recovery.

EXAMPLE 2

The same experimental techniques and conditions as shown in Example 1 were employed in the second test, but no carbon was added to the melt. A seven-gram ingot was recovered and there were a few globules of solid copper distributed in the molten salt. Thus, this example shows that carbon is necessary to obtain any significant copper recovery since the seven-gram ingot repreented only about 5% of the copper contained in the feed.

EXAMPLE 3

Twelve pounds of sodium carbonate were added to and mlted in alumina tube 154. A mixture comprising 3550 grams of the copper matte and 950 grams of coke were placed in hopper 166 and introduced into the molten salt at an average rate of 58 grams per minute. About 2.5 standard cubic feet per minute of air also were injected into the molten salt. The nominal temperature during the test was maintained at about 1100° C. After all of the coke and copper matte had been added, the temperature was reduced to ambient and an 1110-gram ingot of solidified metal was recovered. Upon examination, it was found that the ingot contained salt occlusions, presumably because the temperature in the bottom of the tube was not sufficiently high to completely melt the copper. Approximately 900 to 1000 grams of copper were present in the ingot which corresponds to a recovery of from about 65 to 70 wt % of the copper contained in the matte. A stoichiometric calculation showed that insufficient carbon was present for complete reduction of both the copper and iron sulfide contained in the matte, thus further demonstrating the importance of having a sufficient amount of carbon present in the reaction zone.

EXAMPLE 4

The procedure in Example 3 was repeated except that the amount of carbon added to the hopper was increassed to 1050 grams, the feed rate of the mixture was decreased to approximately 40 grams per minute and the air rate decreased to about 2.0 standard cubic feet per minute. In addition, 100 grams of carbon was added to the reactor at the end of the test to insure that the reduction was complete. As before, the temperature at the base of the metal tube was not sufficiently high to completely melt all of the metal. An 1820-gram ingot was recovered. The ingot was remelted to remove occluded salt and its weight was reduced to 1490 grams. An estimate of the copper recovery based on this weight is 95 to 100% of the copper contained in the matte. A sample of the copper was analyzed, and the results were as set forth in Table 1 below. For comparison, Table 1 also shws an analysis of a typical commercial blister copper obtained from a converter.

TABLE 1

| Wt. % | Cu | Fe | Pb | Zn | Ni |
|---|---|---|---|---|---|
| Test Sample | 98.5 | 0.1 | 0.4 | 0.5 | 0.5 |
| Converter | 99.0 | 0.3 | 0.4 | 0.2 | 0.1 |

EXAMPLE 5

This example demonstrates the application of the present invention to the recovery of lead from a concentrate containing the same. The led concentrate comprised 80 wt % Pb, 14 wt % S, 2 wt % Cu, 2 wt % Fe, and about 2 wt % of other impurities. About 250 grams sodium carbonate, 250 grams potassium carbonate, and 450 grams of a lead sulfide concentrate also were placed in the alumina tube and heated to 732° C. About 20 grams of coke were then added. The temperature was increased to about 815° C. and held there for about one-half hour. Thereafter, the apparatus was cooled to ambient temperature and a 265-gram ingot of greater than 99.9% pure lead was recovered. The 265 grams corresponds to recovery of about 75 wt % of the lead contained in the concentrate. The lower recovery is believed to be caused by the low temperature in the reaction zone. Thus, this example demonstrates the operability of the present invention and also demonstrates the importance of maintaining a sufficiently high temperature to enable the recovery of substantially all of the selected metal from the concentrate; i.e., from about 850° to 1000° C. Further, it is seen that the present method provides a lead product in one step having a purity substnatially equal to that obtained from the prior art processes about several process steps.

EXAMPLE 6

The following example demonstrates the application of the present invention to the treatment of a copper ore concentrate or matte in which there also is provided a regeneration process for the molten reaction mixture as depicted in FIG. 1. Ten thousand pounds per hour of a feed comprising approximately 45% copper, 28% iron, 23% sulfur, 1% lead, 1% zinc, 0.5% nickel. and about 1.5% other metallic constituents is introduced into reaction zone 10. Also introduced into reaction zone 10 is a carbonaceous reducing agent (carbon) in an amount of 2500 lb/hr and air in an amount sufficient to provide 152 lb-mol/hr of oxygen. The reaction zone is maintained at a temperature of from about 1100° to 1350° C. and a pressure in the range of from 1 to 5 atmospheres. A fluid stream of elemental copper is withdrawn via conduit 14, analyzed, and found to have a purity in excess of 99.5%. A bleed stream of the molten salt is withdrawn from the reaction zone and processed to recover the sulfur values and reform the carbonate for return to the reaction zone. The composition and flowrates are set forth in Table 2, wherein the column number corresponds to the conduit numbers set forth in FIG. 1.

EXAMPLE 7

The following example demonstrates the application of the present invention to the treatment of a lead sulfide concentrate in which there also is provided a regeneration process for the molten reaction mixture as depicted in FIG. 1. Ten thousand pounds per hour of a lead matte comprising approximately 80% lead, 2% iron, 14.4% sulfur, 2% copper, and about 1.6% other metallic constituents is introduced into reaction zone 10. Also introduced into reaction zone 10 is a carbonaceous reducing agent (carbon) in an amount of 1600 lb/hr and air in an amount sufficient to provide about 89.5 lb-mol/hr of oxygen. The reaction zone is maintained at a temperature of from about 850 to 1000° C. and a pressure in the range of from 1 to 5 atmospheres. A fluid stream of elemental lead is withdrawn via conduit 14, analyzed and found to have a purity in excess of 99.9%. A bleed stream of the molten salt is withdrawn from the reaction zone and processed to recover the sulfur values and reform the carbonate for return to the reaction zone. The composition and flowrates are set forth in Table 3 wherein the column number corresponds to the conduit numbers set forth in FIG. 1.

TABLE 2

COPPER PROCESS MATERIAL BALANCE

| | 16 Reduced Melt | 20 Make-Up Water | 22 Clarified Solution | 23 Waste Solids | 26 Regen. Waste Gas | 28 Claus Feed Gas | 30 Slurry Product | 34 Claus Oxidizer Air | 38 Claus Tail Gas | 42 Incinerator Air | 44 Hot Gas | 48 Salt Recycle | 50 Vent Gas |
|---|---|---|---|---|---|---|---|---|---|---|---|---|---|
| Solids and Liquids (lb/hr) | | | | | | | | | | | | | |
| C | 500 | | trace | 500 | | | trace | | | | | | |
| $Cu_2O$ | 50 | | trace | 50 | | | trace | | | | | | |
| FeO | 3590 | | trace | 3590 | | | trace | | | | | | |
| PbO | 103 | | trace | 103 | | | trace | | | | | | |
| ZnO | 119 | | trace | 119 | | | trace | | | | | | |
| NiO | 58 | | trace | 58 | | | trace | | | | | | |
| Other | 150 | | trace | 150 | | | trace | | | | | | |
| $Na_2CO_3$ | 5080 | | 5080 | trace | | | 6300 | | | | | 12720 | |
| $Na_2SO_4$ | 850 | | 850 | trace | | | 850 | | | | | 990 | |
| $Na_2S$ | 5700 | | 5700 | trace | | | trace | | | | | trace | |
| $NaHCO_3$ | — | | | — | | | 10330 | | | | | trace | |
| $H_2O$ | — | 36000 | 31000 | 5000 | | 28500 | | | | | | | |
| Gases* (lb-moles/hr) | | | | | | | | | | | | | |
| $N_2$ | | | | | 373 | 200 | | 139 | 339 | 130 | 842 | | 842 |
| $O_2$ | | | | | trace | trace | | 37 | trace | 34.5 | 30 | | 29 |
| $CO_2$ | | | | | 88 | 8 | | | 10 | | 104 | | 167 |
| CO | | | | | 5 | 3 | | | 1 | | trace | | trace |
| $H_2S$ | | | | | trace | 73 | | | 1 | | trace | | trace |
| $SO_2$ | | | | | — | — | | | — | | 1 | | trace |

*All gases are given on a dry basis.

The off-gass from the reaction zone is monitored and found to be nonpolluting, i.e., substantially free of sulfur. In addition, when the gas is used to treat the quenched carbonate solution, and ultimately recover the sulfur values, it is seen that the only effluent gas stream from the process (conduit 50) also is nonpolluting. Further, substantially all of the sulfur constituents of the ore are recovered in elemental form as a salable product (approximately 2300 lb/hr of sulfur via conduit 36).

The off-gas from the reaction zone is monitored and found to be nonpolluting, i.e., substantially free of sulfur. In addition, when the gas is used to treat the quenched carbonate solution, and ultimately recover the sulfur values, it is seen that the only effluent gas stream from the process (conduit 50) also is nonpolluting. Further, substantially all of the sulfur constituents of the ore are recovered in elemental form as a salable product (approximately 1440 lb/hr via conduit 36).

TABLE 3

LEAD PROCESS MATERIAL BALANCE

| | 16 Reduced Melt | 20 Make-Up Water | 22 Clarified Solution | 23 Waste Solids | 26 Regen. Waste Gas | 28 Claus Feed Gas | 30 Slurry Product | 34 Claus Oxidizer Air | 38 Claus Tail Gas | 42 Incinerator Air | 44 Hot Gas | 48 Salt Recycle | 50 Vent Gas |
|---|---|---|---|---|---|---|---|---|---|---|---|---|---|
| Solids and Liquids (lb/hr) | | | | | | | | | | | | | |
| C | 235 | | trace | 235 | | | trace | | | | | | |
| PbO | 54 | | trace | 54 | | | trace | | | | | | |
| $Cu_2O$ | 216 | | trace | 216 | | | trace | | | | | | |
| FeO | 257 | | trace | 257 | | | trace | | | | | | |
| Other | 160 | | trace | 160 | | | trace | | | | | | |
| $Na_2CO_3$ | 1060 | | 1060 | trace | | | 2800 | | | | | 5830<br>710 | |
| $Na_2SO_4$ | 570 | | 570 | trace | | | 570 | | | | | trace | |
| $Na_2S$ | 3590 | | 3590 | trace | | | trace | | | | | trace | |
| $NaHCO_3$ | — | | — | — | | | 4980 | | | | | trace | |
| $H_2O$ | — | 17000 | 16000 | 1000 | | | 14600 | | | | | | |
| Gases* (lb-moles/hr) | | | | | | | | | | | | | |
| $N_2$ | | | | | 225 | 109 | | 87 | 196 | 79 | 500 | | 500 |
| $O_2$ | | | | | trace | trace | | 23 | trace | 21 | 17.5 | | 17 |
| $CO_2$ | | | | | 73 | 4 | | | 5 | | 77 | | 108 |
| CO | | | | | 3 | 1.5 | | | 0.5 | | trace | | trace |
| $H_2S$ | | | | | trace | 46 | | | 1 | | trace | | trace |
| $SO_2$ | | | | | — | — | | | — | | 1 | | trace |

*All gases are given on a dry basis.

While the present invention has been described with respect to certain specific sulfide ore concentrates or mattes containing copper or lead, it will be readily apparent that other copper- or lead-containing sulfide ores are equally suitable as feed materials, providing such ores contain from about 20 to 85 wt % of the selected metal. Thus the term "sulfide ores" as the material treated in accordance with the present invention for the recovery of copper or lead is generally intended to embrace the naturally occurring sulfide ores, minerals, concentrates, and mattes thereof. Further, while the invention has been described in connections with preferred embodiments, temperatures and pressures, numerous variations thereof will be apparent to those versed in the art. Thus, the present invention should not be construed as limited by the foregoing illustrative examples and description, but its scope should be determined in accordance with the following claims.

What is claimed is:

1. A process for the recovery of a metal selected from the group consisting of copper and lead from its respective sulfide ore, said process being performed under conditions resulting in substantially reduced emission of environmental pollutants, comprising:

(a) providing a reaction zone;

(b) introducing said sulfide ore containing from about 20 to 85 wt % of the selected metal, a carbonaceous material, an alkali metal carbonate and gaseous oxygen into said reaction zone to form a molten reaction mixture, said alkali metal carbonate and sulfide ore being introduced in amounts to provide a molar ratio of carbonate to metal sulfide of at least 1.2:1;

(c) said carbonaceous material being introduced in an amount sufficient to reduce substantially all of the selected metal sulfide to the elemental form of the metal and in a sufficient excess os that there is generated in situ substantially all the heat required to maintain the reaction zone at a selected temperature between 600° and 1350° C;

(d) maintaining the reaction zone at said selected temperature for a time sufficient for a reaction to occur in the mixture between the selected metal sulfide, the carbonaceous material and the alkali metal carbonate to form a desired amount of the selected metal in its elemental form in the molten state in a single stage, said molten metal settling to the bottom of the reaction zone; and (e) withdrawing the formed molten metal from the reaction zone as a flowable liquid substantially free of impurities.

2. The process of claim 1 wherein the selected metal is copper.

3. The process of claim 1 wherein the selected metal is lead.

4. The process of claim 2 wherein the reaction zone is maintained at a temperature within the range of from about 1100° to 1350° C.

5. The process of claim 3 wherein the reaction zone is maintained at a temperature within the range of from about 850° to 1000° C.

6. The process of claim 1 wherein a side stream of the molten reaction mixture is withdrawn, quenched with and dissolved in an aqueous solution, and said solution is contacted with carbon dioxide to reform alkali metal carbonate for return to the reaction zone.

7. The process of claim 6 wherein a gaseous reaction product is obtained from the reaction zone and comprises the source of carbon dioxide for use in the reformation of the carbonate.

8. A process for the recovery of a metal selected from the group consisting of copper and lead from its respective sulfide ore, said process being performed under conditions resulting in substantially reduced emission of environmental pollutants, comprising:

(a) providing a reaction zone;

(b) introducing said sulfide ore containing from about 20 to 85 wt % of the selected metal, a carbonaceous material, an alkali metal carbonate and gaseous oxygen into said reaction zone to form a molten reaction mixture, said alkali metal carbonate and sulfide ore being introduced in amounts to provide a molar ratio of carbonate to metal sulfide of at least 1.2:1;

(c) said carbonaceous material being introduced in an amount sufficient to reduce substantially all of the selected metal sulfide to the elemental form of the metal and in a sufficient excess so that there is generated in situ substantially all the heat required to maintain the reaction zone at a selected temperature between 600° and 1350° C.;

(d) maintaining the reaction zone at said selected temperature for a time sufficient for a reaction to occur in the reaction mixture between the selected metal sulfide, the carbonaceous material and the alkali metal carbonate to form a desired amount of the selected metal in its elemental form in the molten state in a single stage, said molten metal settling to the bottom of the reaction zone;

(e) withdrawing the formed molten metal from the reaction zone as a flowable liquid subtantially free of impurities; and (f) withdrawing a side stream of the molten reaction mixture for regeneration of alkali metal sulfide contained therein to reform alkali metal carbonate for return to the reaction zone.

9. The process of claim 8 wherein the seleted metal is copper and the reaction zone is maintained at a temperature within the range of from about 1100° to 1350° C.

10. The process of claim 8 wherein the selected metal is lead and the reaction zone is maintained at a temperature within the range of from about 850° to 1000° C.

11. The process of claim 8 wherein the molten carbonate stream withdrawn in step (f) is quenched with a dissolved in an aqueous solution, and said solution is contacted with a gaseous reaction product produced in the reaction zone to release sulfur constitutents and reform alkali metal carbonate for return to the reaction zone.

* * * * *

UNITED STATES PATENT AND TRADEMARK OFFICE

CERTIFICATE OF CORRECTION

PATENT NO. : 4,164,416

DATED : August 14, 1979

INVENTOR(S) : Dennis C. Gehri

It is certified that error appears in the above-identified patent and that said Letters Patent is hereby corrected as shown below:

Front Page, under [56] References Cited, U.S. Patent "1,881,164" (Freeman) should read --1,888,164--; "Pendor" (2,834,669) should read --Pendar--; "Gelvi" (3,718,733) should read --Gehri--.

Column 3, line 52, "of" should read --or--.

Column 4, line 45, "lest" should read --least--.

Column 7, line 63, "mixturee" should read --mixture--; line 66, "10" should read --20--.

Column 8, line 33, "monor" should read --minor--; line 39, "dry 46" should read --dryer 46--.

Column 9, line 59, "mlted" should read --melted--.

Column 10, line 32, "shws" should read --shows--; line 45, "led" should read --lead--; line 67, "substnatially" should read --substantially--.

Column 13, line 36, "connections" should read --connection--; line 61 (Claim 1), "os" should read --so--.

Column 16, line 10 (Claim 11), "a" (at end of line) should read --and--.

Signed and Sealed this

*Eighteenth* Day of *September 1984*

[SEAL]

*Attest:*

*Attesting Officer*

GERALD J. MOSSINGHOFF

*Commissioner of Patents and Trademarks*